United States Patent [19]

Shoji et al.

[11] Patent Number: 4,786,289

[45] Date of Patent: Nov. 22, 1988

[54] PROCESS FOR PRODUCING A COAL-WATER SLURRY

[75] Inventors: Kazunori Shoji, Kure; Hirofumi Kikkawa, Hiroshima; Hiroshi Takezaki; Yoshinori Ohtani, both of Kure, all of Japan

[73] Assignee: Babcock-Hitachi Kabushiki Kaisha, Tokyo, Japan

[21] Appl. No.: 158,070

[22] Filed: Feb. 12, 1988

Related U.S. Application Data

[63] Continuation of Ser. No. 781,011, Sep. 27, 1985, abandoned.

[30] Foreign Application Priority Data

Sep. 28, 1984 [JP] Japan ..... 59-203761

[51] Int. Cl.[4] ..... C10L 1/32

[52] U.S. Cl. ..... 44/51; 44/620; 241/16; 241/118

[58] Field of Search ..... 44/51, 1 SR, 1 R, 2; 241/14, 16, 24, 29, 52, 118

[56] References Cited

U.S. PATENT DOCUMENTS

| | | | |
|---|---|---|---|
| 2,214,815 | 9/1948 | Hanahan et al. | 241/29 |
| 2,346,151 | 4/1944 | Burk et al. | 241/16 |
| 2,430,085 | 11/1947 | Spencer et al. | 241/29 |
| 2,842,319 | 7/1958 | Reerink et al. | 241/29 |
| 3,169,712 | 2/1970 | Schauer et al. | 241/52 |
| 3,612,418 | 10/1971 | Barton | 241/103 |
| 4,030,893 | 6/1977 | Keller | 44/51 |
| 4,109,871 | 8/1978 | Lohnherr | 241/14 |
| 4,162,045 | 7/1979 | Katzer et al. | 241/16 |
| 4,264,041 | 4/1981 | Kitto, Jr. et al. | 241/57 |
| 4,288,231 | 9/1981 | Taylor | 241/24 |
| 4,432,771 | 2/1984 | Sawyer, Jr. | 44/51 |
| 4,496,367 | 1/1985 | Mathiesen et al. | 44/51 |
| 4,500,041 | 2/1985 | Nakaoji et al. | 241/29 |

FOREIGN PATENT DOCUMENTS

| | | |
|---|---|---|
| 0370763 | 10/1983 | Austria . |
| 3121979 | 2/1982 | Fed. Rep. of Germany . |

*Primary Examiner*—William R. Dixon, Jr.
*Assistant Examiner*—Margaret B. Medley
*Attorney, Agent, or Firm*—Fay, Sharpe, Beall, Fagan, Minnich & McKee

[57] ABSTRACT

A process for producing a coal-water slurry of low viscosity and high coal concentration with a low specific energy and a good efficiency is provided, which process comprises wet-grinding coal by means of a wet vertical ring-roll mill in the presence or absence of a surfactant and recycling a part of the coal ground by the mill, as it is, without classifying it, to the mill through a splitter.

21 Claims, 4 Drawing Sheets

PROCESS FOR PRODUCING A COAL-WATER SLURRY

This application is a continuation of application Ser. No. 781,011, filed 9/27/85.

BACKGROUND OF THE INVENTION

1. Description of the Invention

This invention relates to a process for producing a coal-water slurry. More particularly it relates to a process for producing a coal-water slurry having a high coal concentration and a good fluidity with a low power consumption for grinding.

2. Related Art Statement

In recent years, in order to improve the handling properties of coal as a solid fuel, technical development has been earnestly carried out in a process for slurrying coal particles by dispersing them in water to thereby convert them into a fluid fuel which can be easily handled. A problem in producing a high concentration, low viscosity and stabilized coal-water slurry which makes it possible to effect direct spray-combustion in the form of a boiler fuel is to devise how to adjust slurry-constituting coal particles so as to have a broad particle size distribution to thereby increase their packing density, resulting in a high concentration thereof and also how to effect stabilized dispersion of coal particles in water by the use of a suitable surfactant and thereby reduce its viscosity.

As for a process for producing such a coal-water slurry, a process of wet-grinding coal by means of a continuous wet ball mill in the presence of a surfactant added to thereby effect stabilized dispersion of coal particles in water has generally been employed.

The above-mentioned mill has usually been composed of a horizontally rotating cylinder and steel balls filled therein for example as disclosed in U.S. Pat. No. 450,041. As to coal grinding by means of such a mill, since the balls lifted along the inner wall of the mill freely drop in the case of a low viscosity of slurry inside the mill i.e. a low coal concentration, the grinding is ruled by impact grinding. On the other hand, in the case of a high viscosity i.e. a high coal concentration, since the motion of the balls inside the mill is restricted to make it impossible to freely drop, the balls flow down while rolling on the surface layer of other balls; hence the grinding is ruled by abrasion. In the case of impact grinding, the resulting coal particles have a narrow particle size distribution, while in the case of abrasion, fine particles are formed and the resulting coal particles have a broad particle size distribution. Thus it is seen that a high coal concentration results in much sion and a broad particle size distribution. However, too high a concentration (usually about 55% or higher) results in a higher viscosity to make proceeding of grinding impossible; hence it is necessary to add a surfactant at the time of grinding.

On the other hand, a dry vertical ring-roll mill has been known as a mill consuming a lower power than dry or wet ball mill. The ring-roll mill results in a broad particle size distribution per unit mill since its grinding mechanism resides intrinsically in compression grinding and frictional grinding. However, since small size particles classified inside the mill are removed at the grinding part and preumatic conveyed in the form of fine powder coal to the outside of the system, these small size particles are not re-ground. Thus, the content of fine particles in the fine powder coal is reduced to give only a narrow particle size distribution. When fine powder coal ground by a ball-race mill as an example of the roll mill was mixed with water and an additive and the mixture was adjusted so as to give a viscosity of 1,500 cP, the resulting slurry concentration was 58% and the specific energy required for the grinding was 15 KWH/t which was 60% of that in the case of grinding by means of dry ball mill. Thus when grinding is carried out by means of ball-race mill, the specific energy required for the grinding can be reduced, but since the slurry properties are far inferior to those exhibited when a high concentration wet ball mill was employed, it is the present status that the resulting slurry is unsuitable as a liquid fuel.

Thus in order to practically use a coal-water slurry as a boiler fuel, a problem is raised that a mill should be developed which can produce a slurry having a broad particle size distribution required for giving a high coal concentration of 60% by weight or higher, with a low power consumption. Further, coal contains a large quantity of ash. Thus in order to be free from environmental pollution at the time of combustion of the coal-water slurry, development of a technique for producing a good quality slurry i.e. a coal-water slurry of low ash content has been desired.

The object of the present invention is to provide a process for producing a coal-water slurry free of the above-mentioned drawbacks i.e. a process for producing a coal-water slurry of low vistosity and high coal concentration with a good efficiency and a low power, consumption.

SUMMARY OF THE INVENTION

The present invention resides in a process for producing a coal-water slurry which comprises wet-grinding coal by means of a wet vertical ring-roll mill in the presence or absence of a surfactant and recycling a part of the coal ground by the mill, as it is, without classifying it, to the mill through a splitter.

The quantity of the coal recycled through the splitter to the mill is preferably 10 to 30 times, more preferably 15 to 25 times the quantity of raw material coal fed on the basis of dry coal.

BRIEF DESCTIPTION OF THE DRAWINGS

DETAILED DESCRITION OF PREFERRED EMBODIMENTS

Inside the vertical ring-roll mill, a surfactant may be fed together with coal, followed by grinding the mixture in the presence of the surfactant, but alternatively a surfactant may be subsequently added to and mixed with ground coal. In the case of the latter method, since the surfactant is fed just after grinding of coal and coats the surface of ground coal, the surfactant can be used with good efficiency. Preferably the proportion by weight of coal is 50 to 80% based on the total weight of coal, water and surfactant at the time of grinding and the proportion by weight of the surfactant is 0.05 to 3.0% based thereon.

One of preferred embodiments is a process wherein coal is wet-ground in a relatively low concentration by means of a vertical ring-roll mill without adding any surfactant, followed by deashing the resulting slurry, thereafter dehyrating till the coal concentration reaches 50 to 80% by weight, adding 0.05 to 3% by weight of a surfactant based on the weight of coal, to a mixture of the dehydrated coal with water and stirring the resulting mixture.

The present invention will be described in more detail by way of embodiments.

Figure 1:
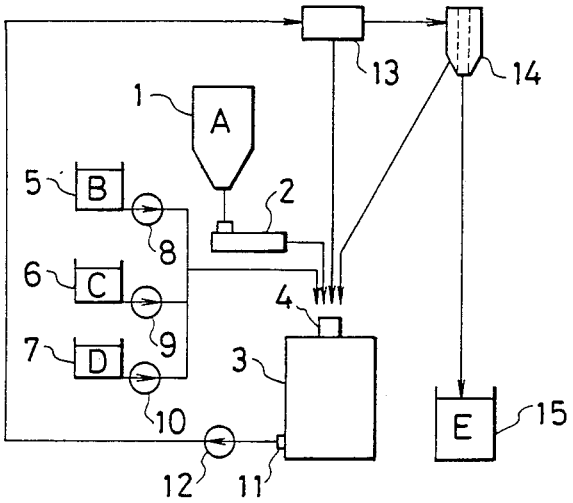
FIG. 1 shows a flow sheet of an apparatus for producing a coal-water slurry directed to an embodiment of the present invention.

FIG. 1 shows an embodiment of preferred apparatus for carrying out the present invention. In FIG. 1, coal A inside a bunker 1 is injected into a wet vertical ring-roll mill 3 via a feeder 2 and through a coal-feeding pipe 4 located at the top part of the mill, and water B, a surfactant solution C and a pH-regulator solution D are injected into the mill from the respective tanks 5, 6 and 7, by means of the respective pumps 8, 9 and 10 through the coal-feeding pipe 4. The mixture of coal ground inside the ring-roll mill 3, water and the additives is discharged through a discharge port 11 at the bottom part of the mill and sent by a slurry pump 12 to a slurry splitter 13 where a portion thereof is recycled through the coal-feeding pipe 4 to the inside of the mill. The remainder of the slurry split at the splitter 13 is sent to a coarse particle-separator 14 provided above the mill and the coarse particles separated there are sent by gravity through the coal-feeding pipe 4 to the inside of the mill. The coal-water slurry passing through the coarse particle-separator 14 is stored as a product in a slurry tank 15.

As for a splitter 13, those of any type may be employed as far as they can split coal particles in the slurry as they are, at an optional ratio without classifying them. A splitter provided with branch pipes each having a flow meter, a flow control valve, and a particle size analyser may be preferably employed. Such an control system is desirable so that a coal particle size in each slurry split is checked and split ratio is varied so that the coal particle size in each slurry split may have an optimum value.

Further, as the above coarse particle-separator 14, those of any type such as strainer, wet screen, sieve bend, etc. may be employed as far as they can separate particles of about 300 to 1,000 μm or larger contained in the slurry. A ratio of a coal-water slurry flowing into the coarse particle separator 14 and a coal-water slurry recycling to the ring roll mill 3 split by the splitter 13 is ordinally in the range of 1 to 1–35, preferably 1 to 10–25.

Figure 2:
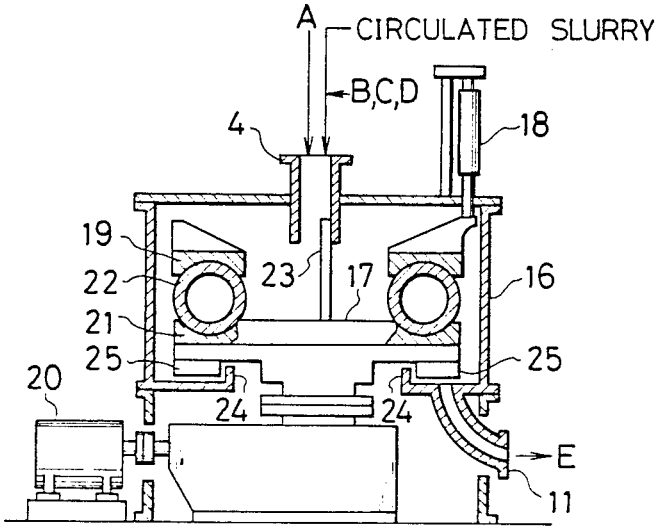
FIG. 2 shows an explanatory view illustrating the structure of a wet vertical ball-race mill as a wet vertical ring-roll mill shown in FIG. 1.

FIG. 2 shows the detailed structure of a wet vertical ball-race mill 3 in the embodiment of FIG. 1.

The grinding part is composed of an upper fixed ring (upper ring) 19 having a pressing force applied by a pressure means (hydraulic cylinder) 18; a grinding table 17 and a lower rotating ring (lower ring) 21 provided at the end part of the grinding table 17 and rotated by a drive 20; a plurality of grinding balls 22 arranged between the upper ring 19 and the lower ring 21 and rolling along with rotation of the lower ring 21; and a scratching rod 23 for sweeping the inside of the coal-feeding pipe, provided eccentrically from the center of the grinding table 17. Coal A to be wet-ground is fed together with a slurry recycled from a splitter 13 (see FIG. 1), a coarse particle slurry from a coarse particle-separator 14 (see FIG. 1), water, a surfactant solution and a pH-regulator solution, to a coal-feeding pipe 4 of the body of the mill 16. The mixture of coal, water and the additives fed to the coal-feeding pipe 4 drops through the inside of the coal-feeding pipe 4, and the mixture adhered onto the inner surface of the coal-feeding pipe 4 is scratched off by the scratching rod 23 for sweeping rotating along with the grinding table 17 and dispersed on the grinding table 17. The mixture of coal, water and the additives dispersed on the grinding table 17 is moved by means of a centrifugal force generated by the rotation of the grinding table 17 to a grinding balls 22-arranged part where it is subjected to compression milling mainly between balls and the lower ring. The ground coal flows down through the clearance part between the end of the lower ring 21 and the body of the mill 16, into the inside of a slurry weir 24 below the grinding table 17, and it is discharged from a discharge port 11 while it is mixed by a paddle mixer 25 provided at the bottom part of the rotating grinding table 17.

Figure 3:
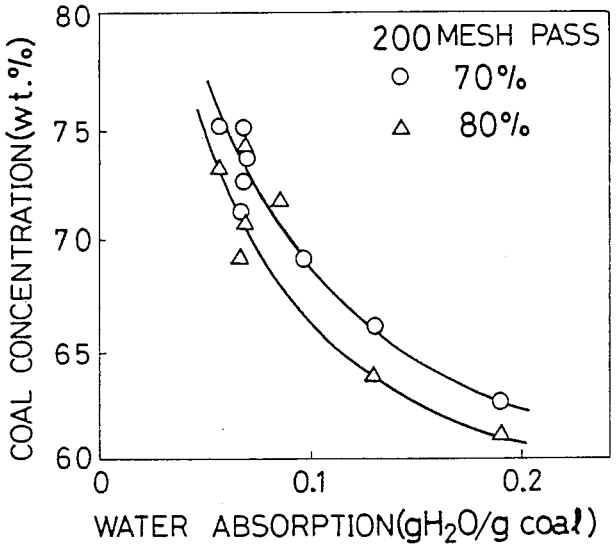
FIG. 3 shows an explanatory chart illustrating a relationship between water absorption and coal concentration.

In the apparatus shown in FIG. 1 and FIG. 2, the coal concentration of the coal-water slurry to be produced is determined depending on the properties of raw material coal and the ground particle size. FIG. 3 shows a chart illustrating the relationship between the hygroscopicity (i.e. the quantity of water absorbed per unit coal weight) of various kinds of coal adjusted so as to have a broad particle size distribution, as shown by a in FIG. 4, and the coal concentrated at the viscosity of 1500 cP of the slurry. Thus, the control of the particle size of the slurry (e.g. 200 meshes pass: 70%) to be determined depending on the conditions of the slurry as fuel is attained by controlling the quantity of raw material coal fed to the ring-roll mill 3, the quantity of water added, the quantity of the additives accompanying the coal and the recycled quantity of slurry inside the mill. In the splitter 13, the slurry in a quantity corresponding to that of raw material coal fed to the mill is sent to the coarse particle-separator 14 where coarse particles are separated and the remainder of the slurry is recycled to the inside of the mill. The recycled quantity of coal from the splitter 13 on the basis of dry coal is preferably 10 to 30 times, preferably 15 to 25 times the quantity of raw material coal fed. Since the volume of the grinding part of the mill is definite, the quantity passing through the grinding part i.e. the total of the quantity of raw material coal fed and the recycled quantity is varied by varying the quantity of raw material coal fed; thus the retention time inside the mill is varied to make it possible to control the size of ground particles. Accordingly when different kinds of coal having different Hardgrove grindability indexes are used, it is possible to produce slurries of the same particle size by varying the quantity of raw material coal fed to the mill. The role of the coarse particle-separator 14 is to remove coarse particles in order tb prevent clogging at burner tip or the like. The proportion by weight of the coarse particles to be removed depends on cut diameter (about 300 to 1,000 μm), but it is usually 1 to 2% or less of the whole.

The present invention will be described in more detail by way of an embodiment wherein the above apparatus is applied.

Figure 4:
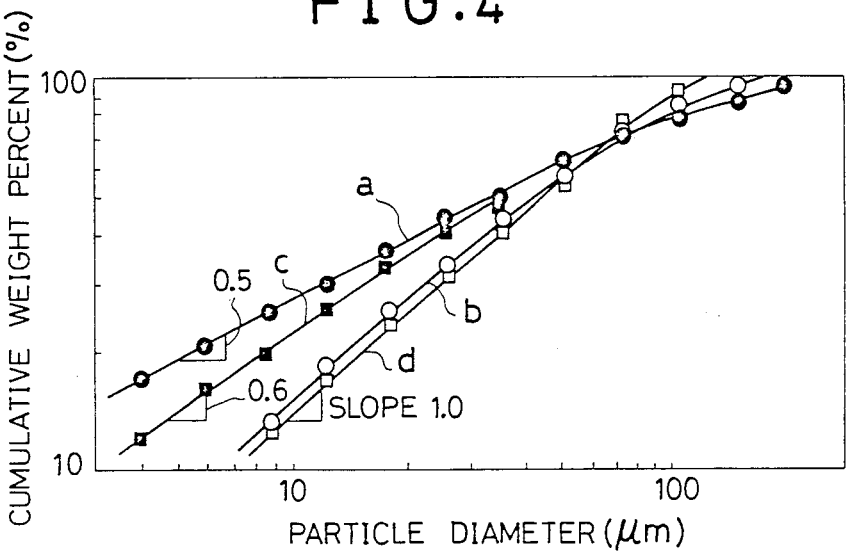
FIG. 4 shows a chart illustrating a relationship between the particle size and cumulative weight fraction of ground coal, for explaining the effectiveness of an embodiment of the present invention.

Employing an apparatus provided with a wet vertical ball-race mill having a rotating table of 165 mm in diameter, and having the same construction as in FIG. 1, a coal having a Hardgrove grindability index (HGI, JIS M8801) of 50 was ground and controlled under the following conditions to observe the particle size distribution of the resulting coal-water slurry (viscosity: 1,500 cP) to obtain the results of a in FIG. 4:

Conditions

Quantity by weight of raw material coal fed to the mill (based on dry coal): 20 Kg/h Quantity by weight of surfactant fed (based on raw material coal): 0.5%

Quantity by weight of pH-regulator fed (based on raw material coal): 0.05%

Coal concentration inside the mill: 70.5% by weight

Recycled quantity of coal from splitter (based on dry coal): 400 Kg/h

Recycled quantity of coal from coarse particle separator: 0.1 Kg/h

In this figure, for comparison, the respective results of a ground material (b) according to a dry ball-race mill, a ground material (c) of a high concentration (70%) and a ground material (d) of a low concentration (50%), each according to a continuous wet ball mill of 650 mm in diameter and 1,250 mm in length are shown together.

Further, the properties of a slurry produced according to an embodiment of the present invention and the power consumption at that time are shown in Table 1 in comparison with those according to conventional process.

because in the case of conventional high concentration grinding by wet ball mill (No. 2), even when the quantity by weight of 200 meshes pass is 70%, to obtain a high concentration coal slurry it is necessary to have a broad particle size distribution (see c), as shown in FIG. 4. In other words, in order to produce fine particles, a large quantity of power is consumed. In the case where the power consumption required for producing a coal-water slurry is 50 KWh/t as above, if the unit cost of raw material coal is e.g. ¥ 5,000 and the unit cost of electric power is e.g. ¥23/KWh, the electric power cost amounts to 150/t which corresponds to 7.7% of the cost of raw material coal; thus it is seen that the power consumption for grinding is enormous.

Whereas in the case of the present invention wherein a wet ring-roll mill is employed and grinding is carried out by recycling a definite quantity of slurry through a splitter (No. 1 in Table 1), coal particles are ground between balls and the lower ring at the grinding part of the ring-roll mill and since the grinding mechanism consists in compression grinding and frictional grinding, the particle size distribution formed per single mill is a broad particle size distribution containing fine particles in a large quantity. Further, formed fine particles are not discharged through classification without being re-ground, but they are recycled to the mill 3 through the splitter 13 and re-ground; hence it is possible to prepare a broad particle size distribution containing fine particles in a large quantity, required for producing a coal-water slurry of high concentration. Thus, as is apparent from Table 1, it is possible to produce a coal-water slurry having the same properties as or superior properties to those of a coal-water slurry (No. 2) according to grinding by wet tube mill, with about $\frac{1}{3}$ of the power consumption required in the above conventional process.

The foregoing description has been made using a typical embodiment of the present invention, but the present invention is not construed to be restricted thereto. For example, FIG. 2 shows a wet vertical ball-race mill as the wet vertical ring-roll mill, but it is possible to use as the roll, various modifications such as beer barrel-form roll, ring-form roll, etc. in addition to ball-form roll in FIG. 2.

TABLE 1

| No. | Mill | Coal concentration at the time of grinding | Time when additives are added | Amount of surfactant | Amount of pH regulator | Coal concentration in 1,500 cP | Stability of slurry | power consumption for grinding | Particle size distribution | Remarks |
|---|---|---|---|---|---|---|---|---|---|---|
| 1 | Wet ring-roll mill | 70.5% | At the time of grinding | 0.5% | 0.05% | 70.5% | good | 30 KWh/t | (a) | Present invention |
| 2 | Ball mill | 70% | At the time of grinding | 0.5% | 0.05% | 70% | good | 50 KWh/t | (c) | Conventional process |
| 3 | Ball mill | 50% | After grinding | 0.5% | 0.05% | 57% | bad | 20 KWh/t | (d) | |
| 4 | Ball mill | dry | After grinding | 0.5% | 0.05% | 57% | bad | 25 KWh/t | — | |
| 5 | Dry ring-roll mill | dry | After grinding | 0.5% | 0.05% | 58% | bad | 15 KWh/t | (b) | |

Figure 5:
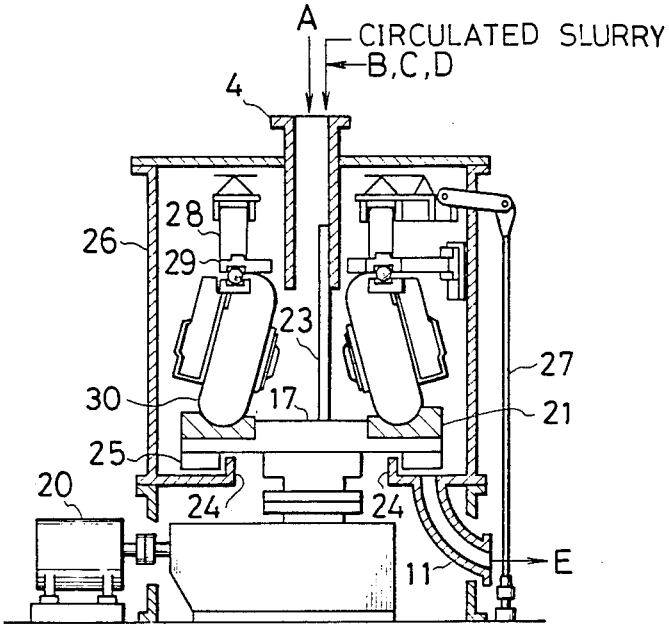
FIG. 5 shows a view illustrating the structure of a wet vertical ring-roll mill employable in place of the wet mill shown in FIG. 2 as the wet mill shown in FIG. 1.

In the above Table, in the case of conventional low concentration (50%) grinding by wet ball mill (No. 3) and conventional grinding by dry ball mill (No. 4), the unit of power consumption required for grinding is 20 to 25 KWh/t, whereas in the case of conventional high concentration (70%) grinding by ball mill (No. 2), the unit is 50 KWh/t, that is, twice the above unit. This is FIG. 5 shows the structure of a wet ring-roll mill wherein a ring-form roll is employed. The grinding part is composed of an upper fixed pressure plate 29 having a pressing force applied thereto by a press rod 27 and a spring 28; a grinding table 17 and a lower ring 21 provided at the circular end of the grinding table 17 rotated by a drive 20; a plurality of grinding rings (grinding rolls) 30 arranged between the upper fixed pressure plate 29 and the lower ring 17 and rotated by rotation of the lower ring 17; and a scratching rod 23 provided on the grinding table 17 and rotated by rotation of the table to prevent adhesion onto the inner surface of a coal-feeding pipe 4.

Coal A to be ground is fed to the coal-feeding pipe 4 of the body 26 of the mill, together with recycled slurries from a splitter 13 (see FIG. 1) and a coarse particle-separator 14 (FIG. 1), and additive solutions. The mixture of coal, water and additives dropped through the coal-feeding pipe 4 and dispersed on the rotating table 17 is moved by centrifugal force toward the outer side; subjected to compression grinding and frictional grinding between the grinding roll 30 and the lower ring 21; flows down from the end of the lower ring 21 into the inside of a weir 24 provided below the grinding table 17 and on the body 26 of the mill; and discharged from a discharge port 11 while it is mixed by a paddle mixer 25 provided at the bottom part of the rotating grinding table 17. In the case of the wet ring-roll mill according to this embodiment, too, since the grinding mechanism consists in compression and friction, coal particles having a broad particle size distribution are formed to make it possible to produce a coal-water slurry of high concentration and low viscosity with a good efficiency and a low specific energy.

Figure 6:
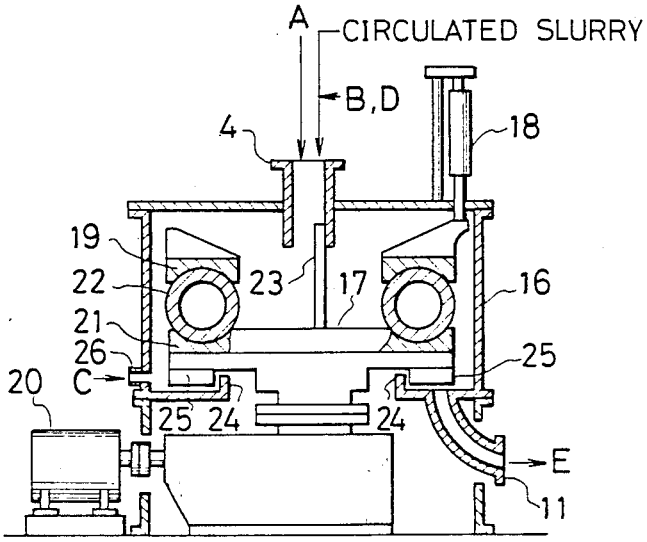
FIG. 6 shows a view illustrating another embodiment of wet ball-race mill employed in the present invention.

FIG. 6 shows the structure of a vertical ball-race mill relative to another embodiment of the present invention. The different point of this apparatus from that of FIG. 2 consists in that a surfactant solution C is not fed to a raw material coal-feeding part (coal-feeding pipe 4) or a grinding part (grinding table 17), but it is fed through a surfactant-injecting port 26 to a weir 24 provded on the lateral wall of the mill, whereby since the surfactant solution is rapidly fed to the ground surface of coal, the solution may be added in a quantity corresponding to the surface area of formed particles to make it possible to reduce the quantity of the surfactant solution fed. In addition, the pH-regulator solution may be similarly added after grinding of coal.

The surfactant may be added after wet-grinding and if necessary, after dehydration until the coal concentration reaches 50 to 80%. The quantity of the surfactant added after grinding is suitably in the range of 0.05 to 3.0% by weight based on the weight of coal. As the surfactant, anionic or nonionic surfactants are suitable.

Figure 7:
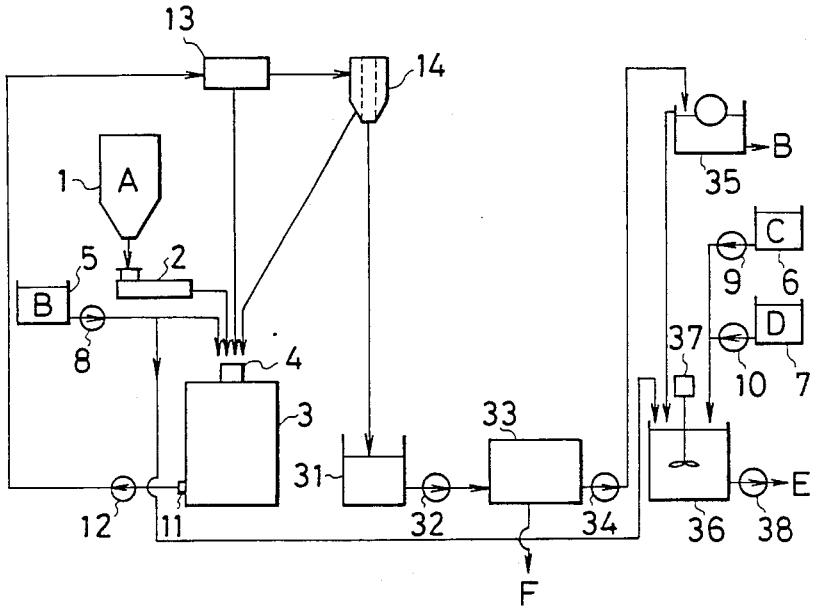
FIG. 7 shows a flow sheet illustrating an apparatus for producing a coal-water slurry of low ash content relative to another embodiment of the present invention.

FIG. 7 shows an explanatory chart of a process for producing a coal-water slurry illustrating another embodiment of the present invention wherein a deashing process is employed at the same time. In FIG. 7, coal A inside a bunker 1 sent via a feeder 2 and water B sent from a tank 5 by means of a pump 8 are fed through a coal-feeding pipe 4 at the top part of a wet vertical ring-roll mill 3 into the mill 3. The coal-water slurry wet-ground inside the ring-roll mill 3 (coal concentration: usually 50% or lower) is fed through a discharge port 11 at the bottom part of the mill by means of a slurry pump 12 to a splitter 13 where it is divided without classification and a portion of the slurry is recycled through the coal-feeding pipe 4 to the inside of the mill. The remainder of the slurry is sent to a coarse particle-separator 14 provided at the upper part of the mill, where coarse particles are separated and recycled by gravity through the coal-feeding pipe 4 of the mill to the inside of the mill 3. The slurry, after the coarse particles have been separated in the coarse particle-separator 14, is stored for a time in a storage tank 31 and sent by a pump 32 to a deashing equipment 33 where ash in coal is separated. The resulting purified coal-water slurry is sent by means of a pump 34 from the deashing equipment 33 to a dehydrator 35 where it is dehydrated till the coal concentration reaches about 50 to 80% or higher. The resulting dehydrated cake is mixed stirring by means of a 37 in a slurry-preparation tank, with water B, surfactant solution C and pH-regulator solution D fed respectively by means of pumps 8, 9 and 10 from the respective tanks 5, 6 and 7 to give a coal-water slurry E having a low ash content, a low viscosity and a coal concentration of about 50 to 80% by weight, which is sent by means of a pump 38 to the subsequent step (not shown, but e.g. storage tank).

As the deashing equipment 33, a wet deashing equipment is preferable, and an equipment according to floatation process is particularly preferable due to its good deashing efficiency. As the dehydrating machine 35, those of any type such as filter press, centrifugal dehydrator, belt filter, etc. may be employed.

This process for producing a coal-water slurry, of the present invention is particularly effective for preparation of a coal-water slurry of low ash content wherein a deashing process is incorporated. The most important factor for improving the percentage deashing is to separate ash from coal contained in coal particles as much as possible. In general, the smaller the particle size at the time of deashing, the more improved the percentage deashing. In the case of conventional, high concentration wet grinding by means of a wet ball mill (coal concentration: about 50% or higher), even if deashing is carried out downstream according to floatation process, the resulting percentage deashing is far inferior. This is because when a high concentration wet grinding by means of a ball mill is carried out, the resulting viscosity becomes high; thus coal particles are made hydrophilic using an additive such as surfactant and dispersed in water to make the viscosity low, but in the case of floatation process, since hydrophobic properties of coal particles contained in coal which are intrinsically present therein are utilized. Coal particles once made hydrophilic and brought into a high concentration slurry are difficult to subject to floatation. On the other hand, in the case where grinding is carried out in a coal concentration of about 50% or lower, since the viscosity is low, no surfactant is required at the time of grinding; thus the percentage deashing according to floatation is good. However, as shown in FIG. 4*b*, since the resulting particle size destribution is narrow, it is impossible to bring the concentration of the slurry after deashing into a high concentration. Thus, as for a process of deashing coal and obtaining a high concentration slurry, it is intended that coal is first ground in a coal concentration of 50% or lower till the proportion by weight of 200 meshes pass reaches about 50% to obtain a narrow particle size distribution, deashed, dehydrated and ground in a high coal concentration till the proportion by weight of 200 meshes pass reaches about 70 to 80% to obtain a broad particle size distribution. In this case, however, there are drawbacks that the particle size at the time of deashing is large; separation of ash from coal does not proceed; hence the percentage deashing is low. Whereas in the case of the present invention, since the grinding mechanism of the wet ring-roll mill consists in compression grinding and frictional grinding, it is possible to obtain a broad particle size distribution in a low concentration; hence it is unnecessary to grind coal in a high coal concentration as in the case of wet ball mill and also it is unnecessary to add a surfactant or the like at the time of grinding. Thus it is possible to apply a deashing operation to coal particles having a proportion by weight of 200 meshes pass of 70 to 80%, containing a large quantity of fine particles and a broad particle size distribution, in an advanced state of separation of ash from coal, without adding any surfactant. Hence a high percentage deashing is obtained and it is possible to produce a slurry of ultimately high coal concentration.

EXAMPLE

Employing a wet vertical ball-race mill having a rotating table of 165 mm in diameter, coal having a Hardgrove grindability index (HGI) of 50 and an ash content of 10.5% by weight was ground in a coal concentration of 40% till the proportion by weight of 200 mesh pass reached 70%. Water was added to the resulting slurry obtained by grinding until the coal concentration reached 5% by weight, followed by deashing the resulting slurry in a floatation cell , concentrating the deashed slurry by means of a belt filter till the coal concentration reached 80%, and adding 0.5% of a surfactant based on the weight of coal and water to produce a slurry having a viscosity of 1,500 cP and a coal concentration of 71% by weight. As a result of analyzing the slurry, the ash content of coal in the slurry was 4% by weight.

For comparison, employing a conventional wet ball mill, the coal was ground in a coal concentration of 40% by weight till the proportion by weight of 200 meshes pass reached 50%, followed by diluting the resulting slurry with water till the coal concentration reached 5% by weight, subjecting the diluted slurry to floatation, dehydrating, grinding under a high concentration, adding 0.5% of a surfactant, and adding water till the viscosity reached 1,500 cP to produce a slurry having an ultimate coal concentration of 69.5% by weight. The ash content of the slurry was 7% by weight. One reason that the coal-water slurry according to the present invention has a higher coal concentration than those of a slurry according to high concentration wet grinding by means of a conventional ball mill (coal concentration: 70%, see Table 1) and a slurry according to wet ring-roll mill (coal concentration: 70.5%, see Table 1), is that a slurrying-obstructing factor (metal ions) contained in ash is removed by the deashing operation. Further, another reason that the slurry of the present invention has a higher coal concentration than that of a deashed coal-water slurry (coal concentration: 69.5%) according to conventional wet tube mill process is that in the case of the conventional process, control of the narrow particle size distribution is once carried out in a low concentration wet griding in advance of deashing, and again by way of a high concentration grinding after deashing which is difficult. In the case of wet ring-roll mill, control of a broad particle size distribution for high concentration is possible at a single stage.

According to the process of the present invention, it is possible to produce a high concentration coal-water slurry suitable for direct combustion with a very good efficiency and hence with a far reduced specific energy. Further, it is also possible to produce a low ash coal-water slurry having ash removed from raw material coal and hence more suitable as high efficiency boiler fuel.

What we claim is:

1. A process for producing a coal-water slurry, which comprises wet-grinding coal by means of a wet vertical ring-roll mill and recycling a part of the coal ground by the mill, as it is, without classifying it, to the mill through a splitter and discharging the coal-water slurry.

2. A process for producing a coal-water slurry according to claim 1 wherein said mill is a wet vertical ball-race mill.

3. A process for producing a coal-water slurry according to claim 1 wherein the quantity by weight of slurry recycled from said splitter to said ring-roll mill is 10 to 30 times the quantity of raw material coal fed to said mill on the basis of dry coal.

4. A process for producing a coal-water slurry according to claim 1 wherein a surfactant is added inside said vertical ring-roll mill to the ground coal.

5. A process for producing a coal-water slurry according to claim 4 wherein the proportion of coal is 50 to 80% and that of said surfactant is 0.05 to 3.0%, each based on the total weight of coal, water and surfactant at the time of grinding.

6. A process for producing a coal-water slurry according to claim 1 wherein said wet-grinding is carried out without adding any surfactant, followed by dehydrating the resulting slurry by means of a dehydrator until the coal concentration reaches 50 to 80% by weight, adding a surfactant in a quantity of 0.05 to 3.0% by weight based on the weight of coal to the dehydrated mixture of coal with water and agitating the resulting mixture.

7. A process for producing a coal-water slurry according to claim 1 wherein after said wet-grinding, the resulting slurry is subjected to a deashing operation, followed by dehydrating the deashed slurry until the coal concentration reaches 50 to 80% by weight, adding a surfactant in a quantity of 0.05 to 3% by weight based on coal to the dehydrated mixture of coal with water and agitating the resulting mixture.

8. A process for producing a coal-water slurry according to claim 3, wherein the quantity by weight of slurry recycled from said splitter to said ring-roll mill is 15 to 25 times the quantity of raw material coal fed to said mill on the basis of dry coal.

9. A process for producing a coal-water slurry according to claim 1, wherein, before the coal-water slurry is discharged, it is fed to a coarse particle-separator to remove coal particles having a size greater than about 300 to 1,000 μm contained in the slurry, said coarse particles then being recycled to the ring-roll mill.

10. A process for producing a coal-water slurry according to claim 9, wherein the ratio of coal-water slurry flowing into the coarse particle-separator to the coal-water slurry recyling to the ring-roll mill is in the range of 1 to 1–35.

11. A process for producing a coal-water slurry according to claim 10, wherein the ratio is 1 to 10–25.

12. A process for producing a coal-water slurry according to claim 5, wherein the amount of coal recycled from the splitter to the ring-roll mill is 10 to 30 times the quantity of raw maerial coal fed.

13. A process for processing a coal-water slurry according to claim 12, wherein the amount of coal recycled is 15 to 25 times the quantity of raw material coal fed.

14. A process for producing a coal-water slurry according to claim 9, wherein the amount of coal ground in the mill is about 40% by weight and the proportion of 200 mesh pass coal particles in the discharged coal-water slurry is about 70% and further wherein water is added to the resulting slurry until the coal concentration is about 5% by weight, followed by deashing the resulting slurry, concentrating the deashed slurry until the coal concentration is about 80% by weight and adding 0.5% by weight of a surfactant, based on the weight of the coal.

15. A process for producing a coal-water slurry according to claim 12, wherein, before the coal-water slurry is discharged, it is fed to a coarse particle-separator to remove coal particles having a size greater than about 300 to 1,000 μm contained in the slurry, said coarse particles then being recycled to the ring-roll mill.

16. A process for producing a coal-water slurry according to claim 15, wherein the quantity by weight of slurry recycled from said splitter to said ring-roll mill is 15 to 25 times the quantity of raw material coal fed to said mill on the basis of dry coal.

17. A process for producing a coal-water slurry according to claim 5, wherein, before the coal-water slurry is discharged, it is fed to a coarse particle-separator to remove coal particles having a size greater than about 300 to 1,000 μm contained in the slurry, said coarse particles then being recycled to the ring-roll mill.

18. A process for producing a coal-water slurry according to claim 17, wherein the ratio of coal-water slurry flowing into the coarse particle-separator to the coal-water slurry recyling to the ring-roll mill is in the range of 1 to 1-35.

19. A process for producing a coal-water slurry according to claim 9, wherein the quantity by weight of slurry recycled from said splitter to said ring-roll mill is 10 to 30 times the quantity of raw material coal fed to said mill on the basis of dry coal.

20. A process for producing a coal-water slurry according to claim 19, wherein the amount of coal recycled is 15 to 25 times the quantity of raw material coal fed.

21. A process for producing a coal-water slurry product, comprising:

minimizing the power consumption for grinding coal to product said product, said product having a broad coal particle size distribution and a 50% to 80% by weight concentration of coal, by grinding the coal with water and a surfactant present in the amoount of 0.05% to 3% by weight based upon the weight of the coal in a wet vertical ring-roll mill to obtain a coal-water slurry, providing a splitter for splitting off a portion of said slurry before classifying the slurry and discharging the remainder of said slurry, and increasing the concentration of fine coal particles in said slurry by recycling said portion of said slurry to said wet vertical ring-roll mill; and separating the coarse particles from said discharged coal-water slurry by removing the coal particles having a size greater than aobut 300 to 1,000 μm to obtain said coal-water slurry product.

* * * * *